United States Patent [19]

Suchanski et al.

[11] 4,265,728

[45] * May 5, 1981

[54] METHOD AND ELECTRODE WITH MANGANESE DIOXIDE COATING

[75] Inventors: Mary R. Suchanski; Jeries I. Bishara, both of Mentor, Ohio

[73] Assignee: Diamond Shamrock Corporation, Dallas, Tex.

[ * ] Notice: The portion of the term of this patent subsequent to Jun. 7, 1994, has been disclaimed.

[21] Appl. No.: 957,474

[22] Filed: Nov. 3, 1978

[51] Int. Cl.[3] ..... C25B 11/16; B05D 5/12

[52] U.S. Cl. ..... 204/290 F; 427/126.3

[58] Field of Search ..... 204/290 K, 57, 61; 427/126.1, 126.3

[56] References Cited

U.S. PATENT DOCUMENTS

| | | | |
|---|---|---|---|
| 3,535,217 | 10/1970 | Amano et al. | 204/96 |
| 3,616,302 | 10/1971 | Osawa et al. | 204/40 |
| 3,627,669 | 12/1971 | Entwisle et al. | 204/290 F |
| 3,775,284 | 11/1973 | Bennett et al. | 204/290 F |
| 4,028,215 | 6/1977 | Lewis et al. | 204/290 F |
| 4,048,027 | 9/1977 | Senderoff | 204/61 |
| 4,051,000 | 9/1977 | Gendron et al. | 204/106 |
| 4,060,476 | 11/1977 | Trepton et al. | 204/290 F |
| 4,072,586 | 2/1978 | DeNora et al. | 204/105 M |

FOREIGN PATENT DOCUMENTS

| | | | |
|---|---|---|---|
| 52481 | 6/1890 | Fed. Rep. of Germany | 204/57 |

OTHER PUBLICATIONS

Morita et al., Electrochimica Acta, vol. 23, pp. 331–335, Pergamon Press.

Preisler, Jr., Applied Electrochem., vol. 6, pp. 311–320, 1976.

*Primary Examiner*—F. C. Edmundson

*Attorney, Agent, or Firm*—Hammond & Littell

[57] ABSTRACT

Disclosed is an electrode for use in electrochemical processes wherein a metal substrate made of a valve metal mesh such as titanium carries a semiconductive intermediate coating consisting of tin and antimony oxides laid down upon the valve metal mesh in a series of layers and an electrocatalytically active top coating of an oxide of manganese, applied in a series of layers or by electroplating and subsequently baked in an oxidizing atmosphere at a temperature in the range of 380° to 420° C.

10 Claims, No Drawings

METHOD AND ELECTRODE WITH MANGANESE DIOXIDE COATING

BACKGROUND OF THE INVENTION

This invention generally relates to electrodes for use in electrochemical processes, having a valve metal substrate carrying an electrocatalytically active coating consisting of a tin and antimony oxides semiconductive intermediate coating and a top coating consisting of an oxide of manganese to provide an electrode at considerably less cost while obtaining low cell voltages for given current densities and long lifetimes for the electrode. More particularly, the present disclosure relates to a much improved electrode having a valve metal substrate, such as titanium, carrying a semiconducting intermediate coating consisting of tin and antimony compounds applied in a series of layers and baked to their respective oxides; and a top coating consisting of an oxide manganese applied by electroplating and baked to convert the electroplated $MnO_2$ to the beta form $MnO_2$ structure at a temperature in the range of 380° to 420° C.

Electrochemical methods of manufacture are becoming ever increasingly important to the chemical industry due to their greater ecological acceptability, potential for energy conservation, and the resultant cost reductions possible. Therefore, a great deal of research and development effort has been applied to electrochemical processes and the hardware for these processes. One major element of the hardware aspect is the electrode itself. The object has been to provide: an electrode which will withstand the corrosive environment within an electrolytic cell; an efficient means for electrochemical production; and an electrode cost within the range of commercial feasibility. Only a few materials may effectively constitute an electrode especially to be used as an anode because of the susceptability of most other substances to the intense corrosive conditions. Among suitable electrode materials are: graphite, nickel, lead, lead alloy, platinum, or platinized titanium. Electrodes of this type have limited applications because of the various disadvantages such as: a lack of dimensional stability; high cost; chemical activity, contamination of the electrolyte; contamination of a cathode deposit; sensitivity to impurities; or high overvoltages. Overvoltage refers to the excess electrical potential above the theoretical potential at which the desired element is discharged at the electrode surface.

The history of electrodes is replete with examples of attempts and proposals to overcome some of the problems associated with the electrode in an electrolytic cell, none of which seems to have accomplished an optimization of the desirable characteristics for an electrode to be used in an electrolytic cell. Currently, in an electrowinning process, for example, the cell is operated at a relatively low current density of less than 1 ampere per square inch (155 milliamperes per square centimeter). The problem in this case is to find an electrode which will have many of the desirable characteristics listed above and additionally have a low half cell voltage at given current densities so as to conserve a considerable amount of energy in the electrochemical process. It is known, for instance, that platinum is an excellent material for use in an electrode to be used as an anode in an electrowinning process and satisfies many of the above-mentioned characteristics. However, platinum is expensive and hence has not been found suitable for industrial use to date. Carbon and lead alloy electrodes have been generally used, but the carbon anode has the disadvantage that it greatly pollutes the electrolyte due to the fast wearing and has an increasingly higher electrical resistance which results in the increase of the half cell potential. This higher half cell potential causes the electrolytic cell to consume more electrical power than is desirable. The disadvantages of the lead alloy anode are that the lead dissolves in the electrolyte and the resulting solute is deposited on the cathode subsequently resulting in a decrease in the purity of the deposit obtained, and that the oxygen overvoltage becomes too high. Another disadvantage of the lead alloy anode in the instance of copper electrowinning is that it is believed that the $PbO_2$ changes to a poor conductor. Oxygen may penetrate below this layer and flake off the film resulting in particles becoming trapped in the deposited copper on a cathode. This causes a degrading of the copper plating which is very undesirable.

It has been proposed that platinum or other precious metals be applied to a titanium substrate to retain their attractive electrical characteristics and further reduce the manufacturing costs. However, even this limited use of precious metals such as platinum which can cost in the range of about $30.00 per square foot ($323.00 per square meter) of electrode surface areas are expensive and, therefore, not desirable for industrial uses. It has also been proposed that the surfaces of titanium be plated electrically with platinum to which another electrical deposit either of lead dioxide or manganese dioxide be applied. The electrodes with the lead dioxide coating have the disadvantage of comparatively high oxygen overvoltages and both types of coatings have high internal stresses when electrolytically deposited with techniques of the prior art and are liable to detach from the surface during commercial usage, contaminating the electrolyte and the product being deposited on the cathode surface. Thus, the current density of such anodes is limited and handling of such anodes must be done with extreme care. Another attempted improvement has been to put a layer of manganese dioxide on the surface of a titanium substrate which is relatively porous in nature and building up a number of layers of the manganese dioxide so as to present an integral coating. This yields relatively low half cell potentials as long as the current density remains below 0.5 ampere per square inch (77.5 milliamperes per square centimeter) but as the current density is increased to near 1 ampere per square inch (155 milliamperes per square centimeter) the half cell potential required rises rather rapidly on this type of electrode, resulting in a considerable disadvantage at higher current densities. Additionally, use of porous substrate materials is expensive. Therefore, to date, none of these proposals have met with much commercial success basically because efficiencies and cost reductions desired have not been achieved to this point.

SUMMARY OF THE INVENTION

It is, therefore, an object of the present invention to provide an electrode having the desired operational characteristics which can be manufactured at a cost within the range of commercial feasibility.

Another object of the present invention is to provide an improved electrode for use in an electrolytic cell which will have better wear characteristics within the given cell environment and a longer electrode lifetime.

These and other objects of the present invention, together with the advantages thereof over existing and prior art forms which will become apparent to those skilled in the art from the detailed disclosure of the present invention as set forth hereinbelow, are accomplished by the improvements herein described and claimed.

It has been found that method for manufacture of an electrode for use in an electrolytic cell can comprise the steps of: selecting a valve metal mesh substrate from the group consisting of aluminum, molybdenum, niobium, tantalum, titanium, tungsten, zirconium, or alloys thereof; applying to at least a portion of the surface area of said valve metal substrate a semiconductive intermediate coating of thermally decomposable compounds of tin and antimony containing 0.1 to 30 weight percent antimony, drying said semiconductive intermediate coating; baking said semiconductive intermediate coating in an oxidizing atmosphere at an elevated temperature to transform the tin and antimony compounds to their respective oxides; and applying to the surface of said semiconductive intermediate coating an electrocatalytically active top coating consisting of compounds of manganese; and baking the top coating in an oxidizing atmosphere at a temperature in the range of 380° to 420° C. to its oxide form.

It has also been found that an electrode for use in an electrolytic cell can comprise: a solid titanium substrate; on at least a portion of the surface of said substrate, a semiconductive intermediate coating consisting of oxides of tin and antimony containing 0.1 to 30 weight percent antimony, in an amount greater than 2 grams per square meter of said substrate surface area; and on the surface of said semiconductive intermediate coating, an electrocatalytically active top coating consisting of an oxide of manganese electroplated thereon and converted to beta $MnO_2$ structure by baking in an oxidizing atmosphere having a temperature in the range of 380° to 420° C. to attain an amount greater tha 300 grams per square meter.

DESCRIPTION OF THE PREFERRED EMBODIMENT

The valve metal substrate which forms the support component of the electrode is an electroconductive metal having sufficient mechanical strength to serve as a support for the coatings and should have high resistance to corrosion when exposed to the interior environment of an electrolytic cell. Typical valve metals include: aluminum, molybdenum, niobium, tantalum, titanium, tungsten, zirconium and alloys thereof. A preferred valve metal based on cost, availability and electrical and chemical properties is titanium. There are a number of forms that the titanium substrate may take in the manufacture of an electrode, including for example: solid sheet material, expanded metal mesh material with a large percentage open area, and a porous titanium with a density of 30 to 70 percent pure titanium which can be produced by cold compacting titanium powder or by a sintering process. Porous titanium is favored by the prior art for its high surface area, but it is expensive. Expanded metal mesh being the least expensive is preferred in the present invention where because of the method of the present invention such substrate material works well at reduced cost. Hereinafter the term solid titanium substrate shell be construed to include expanded metal mesh and solid sheet material.

The semiconductive intermediate coating of tin and antimony oxides is a tin dioxide coating that has been modified by adding portions of a suitable inorganic material, commonly referred to as a "dopent." Dopent of the present case is an antimony compound such as $SbCl_3$ which forms an oxide when baked in an oxidizing atmosphere. Although the exact form of the antimony in the coating is not certain, it is assumed to be present as a $Sb_2O_3$ for purposes of weight calculations. The compositions are mixtures of tin dioxide and a minor amount of antimony trioxide, the latter being present in an amount of between 0.1 and 30 weight percent, calculated on the basis of total weight percent of $SnO_2$ and $Sb_2O_3$. The preferred amount of the antimony trioxide in such a coating is between 3 and 15 weight percent.

There are a number of methods for applying the semiconductive intermediate coating of tin and antimony oxides on the surface of the valve metal substrate. Typically, such coatings may be formed by first physically and/or chemically cleaning the substrate, such as by degreasing and etching the surface in a suitable acid (such as oxalic or hydrochloric acid) or by sandblasting; then applying a solution of appropriate thermally decomposable compounds; drying; and heating in an oxidizing atmosphere. The compounds that may be employed include any inorganic or organic salt or ester of tin and the antimony dopent which are thermally decomposable to their respective oxide forms, including their alkoxides, alkoxy halides, amines, and chlorides. Typical salts include: antimony pentachloride, antimony trichloride, dibutyl tin dichloride, stannic chloride, and tin tetraethoxide. Suitable solvents include: amyl alcohol, benzene, butyl alcohol, ethyl alcohol, pentyl alcohol, propyl alcohol, toluene, and other organic solvents as well as some inorganic solvents such as water. Furthermore, use of sulfuric acid with the metal chlorides or use of tin sulfate will result in higher tin retension levels and are therefore preferred in the present invention.

The solution of thermally decomposable compounds, containing salts of tin and antimony in the desired proportion, may be applied to the cleaned surface of the valve metal substrate by brushing, dipping, rolling, spraying, or other suitable mechanical or chemical methods. The coating is then dried by heating at about 100° to 200° C. to evaporate the solvent. This coating is then baked at a higher temperature such as 250° to 800° C. in an oxidizing atmosphere to convert the tin and antimony compounds to their respective oxides. This procedure is repeated as many times as necessary to achieve a desired coating thickness or weight appropriate for the particular electrode to be manufactured. For solid sheet titanium, the desired thickness can be obtained by applying 2 to 6 coats of the tin and antimony compounds. Alternatively, a desired thickness of the semiconductive intermediate coating can be built up by applying a number of layers with drying between applications such that the baking process to convert the tin and antimony compounds to their respective oxides is preformed only once at the end of a series of layering steps.

The top coating of the electrode, of manganese dioxide, can be applied by several methods, such as dipping, electroplating, spraying or other suitable methods. The top coating can be layered in the same fashion as the intermediate coating to build up a thickness or weight per unit area as desired for the particular electrode. In the case of titanium mesh, one method for applying the manganese dioxide prior to drying is to electroplate manganese dioxide directly onto the coated electrode. Because of the rather large open areas in a mesh used for these foraminous electrodes, the electroplating is a more effective method of applying the manganese dioxide to assure a complete and even coverage of the entire surface of the electrode. If titanium plate or porous titanium is used, the thermally decomposable manganese compounds may be painted or sprayed on the electrode in a series of layers with a drying period between each layer and a brushing off of any excess material present on the surface after drying. After the strip is allowed to dry at room temperature, it can then be baked for short periods of time at an elevated temperature in the range of 380° to 420° C. to transform the manganese compounds into manganese dioxide. It has been found that this temperature range yields significant improvement in the lifetimes of resultant electrodes.

The preferred method of applying the topcoating of manganese dioxide is by electroplating from a bath containing $Mn(NO_3)_2$. This is accomplished by centering the electrode material between two cathodes in a plating bath and applying an electrical current while maintaining an elevated bath temperature to build up a thickness or weight per unit area as desired for the particular electrode. The bath temperature should be in the range of 95° to 100° C. The current density should be in the range of 1 to 3 mA/cm$^2$. After a time period in the range of 20 to 40 hours, the electrode will attain a weight gain in the range of 300 to 500 g/m$^2$. The electrode is then baked in an oven having a temperature in the range of 380° to 420° C. for a time period in the range of 0.5 to 24 hours to convert the $MnO_2$ to the beta form $MnO_2$ structure for best results.

Using the above method will permit the use of less expensive solid titanium substrate materials to achieve good electrode loadings and lifetimes at potentials commercially acceptable.

Major uses of this type of electrode are expected to be in: the electrodeposition of metals from aqueous solutions of metal salts, such as electrowinning of antimony, cadmium, chromium, cobalt, copper, gallium, indium, manganese, nickel, thallium, tin, or zinc; production of hypochlorite; and in chloralkali cells for the production of chlorine and caustic. Other possible uses include: cathodic protection of marine equipment, electrochemical generation of electrical power, electrolysis of water and other aqueous solutions, electrolytic cleaning, electrolytic production of metal powders, electroorganic synthesis, and electroplating. Additional specific uses might be for the production of chlorine or hypochlorite.

In order that those skilled in the art may more readily understand the present invention and certain preferred aspects by which it may be carried into effect, the following specific examples are afforded.

EXAMPLE 1

A solution for the semiconductive intermediate coating was prepared by mixing 30 ml of butyl alcohol, 6 ml of concentrated sulphuric acid ($H_2SO_4$), 1.1 grams of antimony trichloride ($SbCl_3$), and 9.7 grams of stannic chloride pentahydrate ($SnCl_4 \cdot 5H_2O$). A strip of titanium (Ti) mesh with an approximately 0.033 cm layer of porous titanium on both sides was coated by brush with the Sn and Sb sulphate solution, dried at 120° C. for 30 minutes and then baked at 600° C. for 30 minutes. This procedure was repeated three times to yield a surface layer of $SnO_2$ and $Sb_2O_3$ (85.6%:14.4% by weight). Twelve coats of a 50% aqueous solution of $Mn(NO_3)_2$ were applied by brush to the titanium followed by heating at 235° C. for 30 minutes after each coating application. A total weight gain of $MnO_2$ of 386 g/m$^2$ was obtained. The anode potential in 150 gpl $H_2SO_4$ at 50° C. was 1.48 V vs. SCE at 0.15 A/cm$^2$ and 1.57 V at 0.45 A/cm$^2$. The anode lifetime (measured as the time for the total cell voltage to reach 8 volts) in a solution of 150 gpl $H_2SO_4$ at 50° C. operating at a current density of 0.45 A/cm$^2$ was 224 hours.

EXAMPLE 2

A strip of titanium mesh with an approximately 0.033 cm layer of porous titanium on both sides was coated with $SnO_2$ and $Sb_2O_3$ as described in Example 1. Twelve coats of a 50% aqueous solution of $Mn(NO_3)_2$ were then applied by brush to the titanium sheet followed by heating at 315° C. for 30 minutes after each coating application. A total weight gain of $MnO_2$ of 463 g/m$^2$ was obtained. The anode lifetime in a solution of 150 gpl $H_2SO_4$ at 50° C. operating at a current density of 0.45 A/cm$^2$ was 540 hours.

EXAMPLE 3

A strip of titanium mesh with an approximately 0.033 cm layer of porous titanium on both sides was coated with $SnO_2$ and $Sb_2O_3$ as described in Example 1. Twelve coats of a 50% aqueous solution of $Mn(NO_3)_2$ were then applied by brush to the titanium sheet followed by heating at 400° C. for 30 minutes after each coating application. A total weight gain of $MnO_2$ of 643 g/m$^2$ was obtained. The anode is still running after 900 hours in a solution of 150 gpl $H_2SO_4$ at 50° C. operating at a current density of 0.45 A/cm$^2$. Table 1 below more clearly shows the effect of bake temperature on the anode performance.

EXAMPLE 4

A strip of titanium mesh was coated with the Sn and Sb sulphate solution described in Example 1, dried at 120° C. for 15 minutes and then baked at 600° C. for 15 minutes. This procedure was repeated three times to yield a surface layer of $SnO_2$ and $Sb_2O_3$ (85.6%:14.4% by weight). Twelve coats of a 50% aqueous solution of $Mn(NO_3)_2$ were applied by brush to the titanium followed by heating at 235° C. for 15 minutes after each coating application. A total weight gain of $MnO_2$ of 171 g/m$^2$ was obtained. The anode lifetime in a solution of 150 gpl $H_2SO_4$ at 50° C. operating at a current density of 0.45 a/cm$^2$ was 28 hours.

EXAMPLE 5

A strip of titanium mesh was coated with the Sn and Sb sulphate solution as described in Example 4. Sixteen coats of a 50% aqueous solution of $Mn(NO_3)_2$ were applied by brush to the titanium followed by heating at 400° C. for 15 minutes after each coating application. A total weight gain of 909 grams $MnO_2$/m$^2$ was obtained. The anode lifetime in a solution of 150 gpl $H_2SO_4$ at 50° C. operating at a current density of 0.45 A/cm$^2$ was 1512 hours.

EXAMPLE 6

A strip of titanium mesh was coated with the Sn and Sb sulfate as described in Example 4. Fifteen coats of a 50% aqueous solution of $Mn(NO_3)_2$ were applied by brush to the titanium followed by heating at 400° C. for 15 minutes aftereach coating application. A total weight gain of 742 g $MnO_2/m^2$ was obtained. The anode has maintained a stable half cell potential for 4000 hours in a solution of 150 gpl $H_2SO_4$, 50° C. at a current density of 0.075 $A/cm^2$.

EXAMPLES 7-24

Several strips of titanium mesh were coated with the Sn and Sb sulphate solution as described in Example 4. These were then coated with a 50% aqueous solution of $Mn(NO_3)$ by brush application and baked at various temperatures according to Table 1 below to attain $MnO_2$ catalyst loadings as shown. The results of life testing are shown in Table 1 below.

TABLE 1

Comparison of $MnO_2$ Anode Lifetime as a Function of the Bake Temperature

| Example No. | Bake Temperature of the $MnO_2$ Topcoat (°C.) | Catalyst Loading (g $Mn/m^2$) | Lifetime, 0.45 $A/cm^2$ 150 gpl $H_2SO_4$, 50° C. (hours) |
|---|---|---|---|
| 7 | 235 | 276 | 182 |
| 8 | 245 | 304 | 272 |
| 9 | 255 | 260 | 264 |
| 10 | 265 | 285 | 357 |
| 11 | 275 | 277 | 327 |
| 12 | 285 | 296 | 405 |
| 13 | 295 | 296 | 488 |
| 14 | 305 | 355 | 625 |
| 15 | 315 | 292 | 540 |
| 16 | 340 | 305 | 514 |
| 17 | 360 | 306 | 619 |
| 18 | 380 | 256 | 852 |
| 19 | 400 | 405 | 1355 |
| 20 | 420 | 354 | 1231 |
| 21 | 440 | 256 | 442 |
| 22 | 460 | 417 | 244 |
| 23 | 480 | 362 | 217 |
| 24 | 500 | 313 | 0 |

EXAMPLE 25

A 20 mil thick Ti sheet (5 cm × 12 cm) was etched in a mixture of distilled $H_2O$ and HCl (50:50) and then coated with a semiconductive intermediate coating of Sb doped $SnO_2$. This was accomplished by painting a solution consisting of 30 ml n-butyl alcohol, 6 ml of concentrated sulfuric acid ($H_2SO_4$), 1.1 g of antimony trichloride ($SbCl_3$) and 9.7 g of stannic chloride pentahydrate ($SnCl_4 \cdot 5H_2O$) onto the Ti sheet, drying the sheet at 120° C. for 15 minutes and then baking it at 600° C. for 15 minutes. This procedure was repeated three times. The Ti sheet was centered between two Ti rod cathodes (⅜" diameter) in a plating bath consisting of 300 ml of 50% aqueous $Mn(NO_3)_2$ and 10 g of a surfactant available commercially from Rohn & Haas Co. under the trademark TRITON X100. The electrolyte was heated to 95° C. and electrolyte agitation was maintained by means of a magnetic stirring motor. A total current of 0.45 amps (3.75 $mA/cm^2$) was applied to the cell for 18 hours after which time the anode was removed from the cell, rinsed in distilled water and dried at 100° C. The anode was then baked for 1 hour at 400° C. to convert the electrolytic $MnO_2$ to the $MnO_2$ structure. A very adherent, metallic, gray deposit with a total weight gain of 1.8 g of $MnO_2$ (150 $g/m^2$ $MnO_2$) was obtained by this method. The anode potential in a solution of 150 gpl $H_2SO_4$ at 50° C. was 1.49 volts vs. SCE at 0.15 $A/cm^2$ and 1.54 volts vs. SCE at 0.45 $A/cm^2$.

EXAMPLE 26

An 80 mil thick Ti mesh was sandblasted and etched in a mixture of distilled $H_2O$ and HCl (50:50) and then coated with an intermediate layer of Sb doped $SnO_2$ according to the procedure in Example 1. The Ti mesh was then centered between two Ti rod cathodes (⅜" diameter) in a plating bath consisting of 800 ml of 2 M Mn $(NO_3)_2$ and 0.5 g of a surfactant available from Rohn & Haas Co. and the trademark TRITON X100. The electrolyte was heated to 95° C. and stirred by means of a magnetic stirring motor. A total current of 0.085 amps (3.4 $mA/cm^2$) was applied to the cell for 17 hours after which time the anode was removed from the cell, rinsed in distilled water and dried at 100° C. A very adherent, metallic, gray deposit (341 $g/m^2$ $MnO_2$) was obtained by this method. After baking the anode for 1 hour at 400° C., the electrode was polarized anodically at a current density of 0.75 $A/cm^2$ in a solution of 150 gpl $H_2SO_4$ at 50° C. The anode lifetime (measured as the time for the total cell voltage to reach 8.0 volts) was 312+ hours. It can be seen from the weight gain that Ti mesh yields superior lifetimes.

EXAMPLES 27-37

Pieces of 060 Ti mesh were etched in a mixture of distilled $H_2O$ and HCl (50:50) and then coated with an intermediate layer of Sb doped $SnO_2$ according to the procedure in Example 1. The Ti mesh was then centered between two It rod cathodes (⅜" diameter) in a plating bath consisting of $MnSO_4$ for Examples 27 through 29 and $Mn(NO_3)_2$ for Examples 30 through 37. The anodes were plated with $MnO_2$ according to the data of Table 2 below. Following the electroplating the anode was baked. This procedure yielded a surface coverage as stipulated $MnO_2$. The electrode was polarized anodically at a current density of 0.75 $A/cm^2$ in a solution of 150 gpl $H_2SO_4$ at 50° C. to derive the lifetime data shown in Table 2 below.

TABLE 2

COMPARISON OF ANODES ELECTROPLATED FROM $MnSO_4$ BATH VS. FROM $Mn(NO_3)_2$ BATH

| Example No. | Electrolyte M $MnSO_4$ | Free Acid gpl $HNO_3$ | Current Density $mA/cm^2$ | Post Bake °C./min | $MnO_2$ Loading $g/m^2$ | Lifetime 150 gpl $H_2SO_4$ 0.75 $A/cm^2$ |
|---|---|---|---|---|---|---|
| 27 | 1.0 | 2 | 2 | 400/30 | 254 | 7 |
| 28 | 1.0 | 8 | 1.3 | 400/30 | 171 | 95 |
| 29 | 1.0 | 15 | 1.3 | 400/30 | 187 | 13 |
| | Electrolyte M $Mn(NO_3)_2$ | | | | | |
| 30 | 2.0 | 8 | 3 | 400/45 | 386 | 164 |
| 31 | 2.0 | 30 | 3 | 400/30 | 398 | 211+ |
| 32 | 3.0 | 8 | 3 | 400/30 | 396 | 215 |
| 33 | 3.0 | 16 | 3 | 400/45 | 411 | 193 |

TABLE 2-continued

COMPARISON OF ANODES ELECTROPLATED FROM $MnSO_4$ BATH VS. FROM $Mn(NO_3)_2$ BATH

| | | | | | | |
|---|---|---|---|---|---|---|
| 34 | 3.0 | 32 | 3 | 400/30 | 416 | 238+ |
| 35 | 4.4 | 5 | 2 | 400/30 | 294 | 312 |
| 36 | 4.4 | 50 | 2 | 400/30 | 298 | 417 |
| 37 | 4.4 | 67 | 2 | 400/60 | 284 | 257 |

Thus, it should be apparent from the foregoing description of the preferred embodiment that the composition hereindescribed accomplishes the objects of the invention and solves the problems that are attendant to such electrode compositions for use in electrolytic cells for electrochemical production.

What is claimed is:

1. A method for manufacture of an electrode for use in an electrolytic cell comprising the steps of: selecting a valve metal substrate from the group consisting of aluminum, molybdenum, niobium, tantalum, titanium, tungsten, zirconium or alloys thereof; applying to at least a portion of the surface area of the valve metal substrate a semi-conductive intermediate coating of thermally decomposable compounds of tin and antimony containing 0.1 to 30 weight percent antimony, drying the semi-conductive intermediate coating; baking the semi-conductive intermediate coating in an oxidizing atmosphere at an elevated temperature to transform the tin and antimony compounds to their respective oxides; and applying to the surface of the semi-conductive intermediate coating a coating of thermally decomposable compounds of manganese, drying the top coating and baking the top coating in an oxidizing atmosphere at a temperature in the range of 380° to 420° C. to its oxide form.

2. A method according to claim 1 wherein said semi-conductive intermediate coating is applied in a series of layers, each being dried before subsequent application of the next layer, and being baked at the conclusion thereof to their respective oxides.

3. A method according to claim 1 wherein titanium mesh is selected.

4. A method for manufacture of an electrode for use in an electrolytic cell comprising the steps of: selecting a valve metal substrating from the group consisting of aluminum, molybdenum, niobium, tantalum, titanium, tungsten, zirconium, or alloys thereof; applying to at least a portion of the surface area of the valve metal substrate a semi-conductive intermediate coating of thermally decomposable compounds of tin and antimony containing 0.1 to 30 weight per antimony, drying the semi-conductive intermediate coating; baking the semi-conductive intermediate coating in an oxidizing atmosphere at an elevated temperature to transform the tin and antimony compounds to their respective oxides; and electroplating onto the surface of the semi-conductive intermediate coating a top coating of an oxide of manganese; and baking the top coating in an oxidizing atmosphere at a temperature in the range of 380° to 420° C. to convert the manganese oxide to the beta form oxide.

5. A method according to claim 4 wherein the top coating attains a weight gain in excess of 300 grams per square meter.

6. A method according to claim 5 wherein the top coating is applied from a bath of manganese nitrate.

7. A method according to claim 6 wherein the electroplating bath is maintained in the temperature range of 95° to 100° C. and the electrical current density is maintained in the range of 1 to 3 $mA/cm^2$ for a time period in the range of 20 to 40 hours.

8. A method according to claim 7 wherein the weight gain of $MnO_2$ is in the range of 300 to 500 $grams/m^2$.

9. A method according to claim 8 wherein the top coating is baked for a time period up to 24 hours.

10. An electrode for use in an electrolytic cell comprising: a solid titanium substrate; on at least a portion of the surface of said substrate, a semiconductive intermediate coating consisting of oxides of tin and antimony containing 0.1 to 30 weight percent antimony, in an amount greater than 2 grams per square meter of said substrate surface area; and on the surface of said semi-conductive intermediate coating, an electrocatalytically active top coating consisting of an oxide of manganese electroplated thereon and converted to beta $MnO_2$ structure by baking in an oxidizing atmosphere having a temperature in the range of 380° to 420° C. to attain an amount greater than 300 grams per square meter.

* * * * *